US009214770B2

(12) United States Patent
Lee

(10) Patent No.: US 9,214,770 B2
(45) Date of Patent: Dec. 15, 2015

(54) POWER SOCKET AND ADAPTOR HAVING THE SAME

(71) Applicant: Chicony Power Technology Co., Ltd., New Taipei (TW)

(72) Inventor: Po-Sheng Lee, New Taipei (TW)

(73) Assignee: CHICONY POWER TECHNOLOGY CO., LTD., New Taipei (TW)

( * ) Notice: Subject to any disclaimer, the term of this patent is extended or adjusted under 35 U.S.C. 154(b) by 33 days.

(21) Appl. No.: 14/245,428

(22) Filed: Apr. 4, 2014

(65) Prior Publication Data

US 2015/0288112 A1 Oct. 8, 2015

(51) Int. Cl.
*H01R 13/627* (2006.01)
*H01R 24/28* (2011.01)
*H01R 105/00* (2006.01)

(52) U.S. Cl.
CPC ..... *H01R 24/28* (2013.01); *H01R 2105/00* (2013.01)

(58) Field of Classification Search
CPC ..... H01R 24/28; H01R 2105/00
USPC ..... 439/660, 79, 736, 677, 680, 456, 656, 439/466
See application file for complete search history.

(56) References Cited

U.S. PATENT DOCUMENTS

| | | | | |
|---|---|---|---|---|
| 3,075,167 | A * | 1/1963 | Kinkaid | 439/636 |
| 3,720,907 | A * | 3/1973 | Asick | 439/636 |
| 5,135,407 | A * | 8/1992 | Berends | 439/236 |
| 5,746,618 | A * | 5/1998 | Gauker | 439/352 |
| 6,361,336 | B1 * | 3/2002 | Zhao et al. | 439/157 |
| 7,029,291 | B2 * | 4/2006 | Chen | 439/79 |
| 2009/0246996 | A1 * | 10/2009 | Ogata et al. | 439/345 |
| 2011/0124218 | A1 * | 5/2011 | Huang | 439/374 |
| 2011/0151715 | A1 * | 6/2011 | Engbring et al. | 439/587 |
| 2011/0306226 | A1 * | 12/2011 | Montena | 439/345 |

* cited by examiner

*Primary Examiner* — Abdullah Riyami
*Assistant Examiner* — Nelson R Burgos-Guntin
(74) *Attorney, Agent, or Firm* — Chun-Ming Shih; HDLS IPR Services

(57) ABSTRACT

Disclosed are a power socket and an adapter having the socket. The power socket includes an insulating base and a plurality of conductive pins, and the insulating base includes a base body, an extension protruded from the base body, a slot formed on an end surface of the base body, a plurality of through hole formed on the extension and interconnected to the slots, and a penetrating hole formed on the extension and at a position corresponding to each respective through hole and penetrating the through hole, and each conductive pin is embedded into the through hole, and an end of each conductive pin is exposed from the slot, and the other end of the conductive pin is formed on an inner side of the penetrating hole, so as to simplify the manufacturing procedure and lower the manufacturing cost.

15 Claims, 5 Drawing Sheets

POWER SOCKET AND ADAPTOR HAVING THE SAME

FIELD OF THE INVENTION

The present invention relates to a power socket, and more particularly to an AC power socket and an adapter having the socket.

BACKGROUND OF THE INVENTION

Power socket is used extensively in electric appliances/products such as portable stereos or DVD players and information products such as computers, and a power cord with connectors at both ends are plugged into a power socket and a utility power socket of the product, so that the product can receive electric power for its operation.

In general, a conventional power socket comprises an insulating base and a plurality of conductive terminals, and a part of each conductive terminal is embedded into the insulating base, and an end of each conductive terminal is coupled to a metal plate by a punch riveting process to form the power socket.

However, the conductive terminal and the metal plate of the conventional power socket are coupled by the punch riveting process, and the riveting position between the conductive terminal and the metal plate may be loosened easily due to insufficient riveting strength or damages by external forces, and thus producing sparks by high temperature, causing a poor contact or separated components, and affecting the safety of the product. The aforementioned punch riveting process not just requires specific tools only, but also involves a complicated manufacturing procedure to operate the punch riveting equipments and incurs a higher manufacturing cost. Obviously, the conventional power socket requires improvements.

SUMMARY OF THE INVENTION

Therefore, it is a primary objective of the present invention to provide a power socket and an adapter having the socket, so as to achieve the effects of simplifying the manufacturing procedure and lowering the manufacturing cost.

To achieve the aforementioned objective, the present invention provides a power socket comprising an insulating base and a plurality of conductive pins, wherein the insulating base comprises a base body, an extension protruded from the base body, a slot formed on an end surface of the base body, a plurality of through holes formed on the extension and interconnected to the slot, and a penetrating hole formed on the extension and at a position corresponding to each respective through hole and penetrating through the through hole, and each conductive pin is embedded into the through hole, and an end of each conductive pin is exposed from the slot, and the other end of the conductive pin is formed on an internal side of the penetrating hole.

To achieve the aforementioned objective, the present invention provides an adapter comprising a power socket and a plurality of conductive wires, wherein the power socket includes an insulating base and a plurality of conductive pins, and the insulating base includes a base body, an extension protruded from the base body, a slot formed on an end surface of the base body, a plurality of through holes formed on the extension and interconnected to the slot, and a penetrating hole formed on the extension and at a position corresponding to each respective through hole and penetrating through the through hole; each conductive pin is embedded in the through hole, and an end of each conductive pin is exposed from the slot, and the other end of the conductive pin is formed on an inner side of the penetrating hole; and an end of each conductive wire is plugged into the penetrating hole to electrically couple the conductive pin.

The present invention further has the following effects: The axis of the penetrating hole and the axis of the through hole are perpendicular to each other, so that the invention can prevent the conductive wire from being pulled and separated. In addition, the cover plate is provided for covering the junction of the conductive wire and the conductive pin, so that electric arcs and sparks produced during the electric connection can be shielded completely.

DESCRIPTION OF THE PREFERRED EMBODIMENTS

Figure 1:
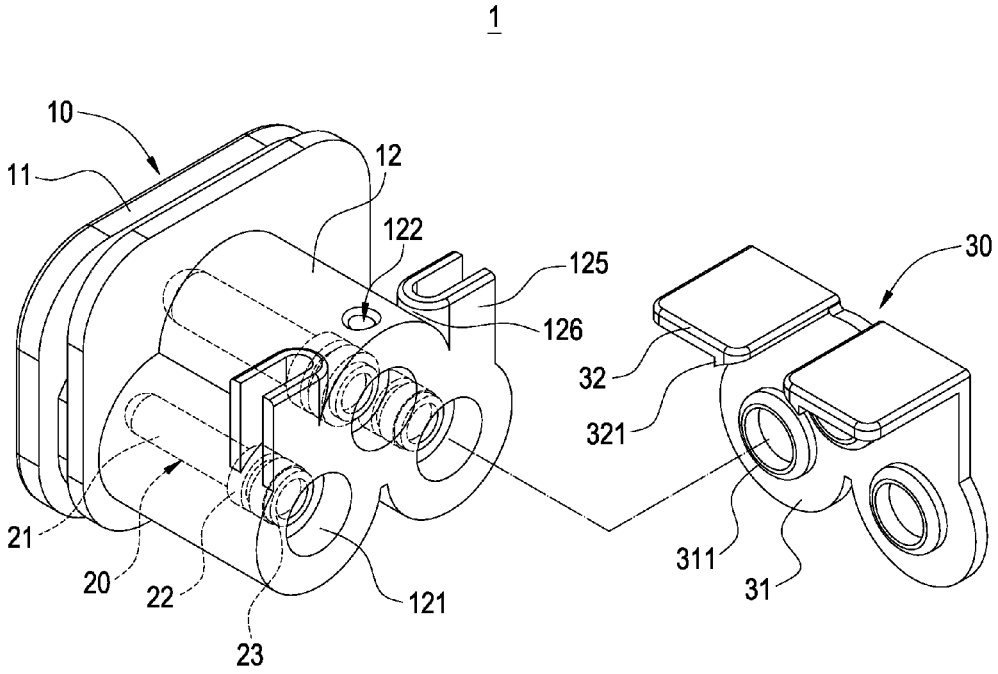
FIG. 1 is an exploded view of a power socket of the present invention.

The technical contents of the present invention will become apparent with the detailed description of preferred embodiments accompanied with the illustration of related drawings as follows. It is noteworthy that same numerals are used for representing same respective elements in the drawings.

With reference to FIGS. 1 to 5 for a power socket of the present invention, the power socket 1 comprises an insulating base 10 and a plurality of conductive pins 20.

Figure 4:
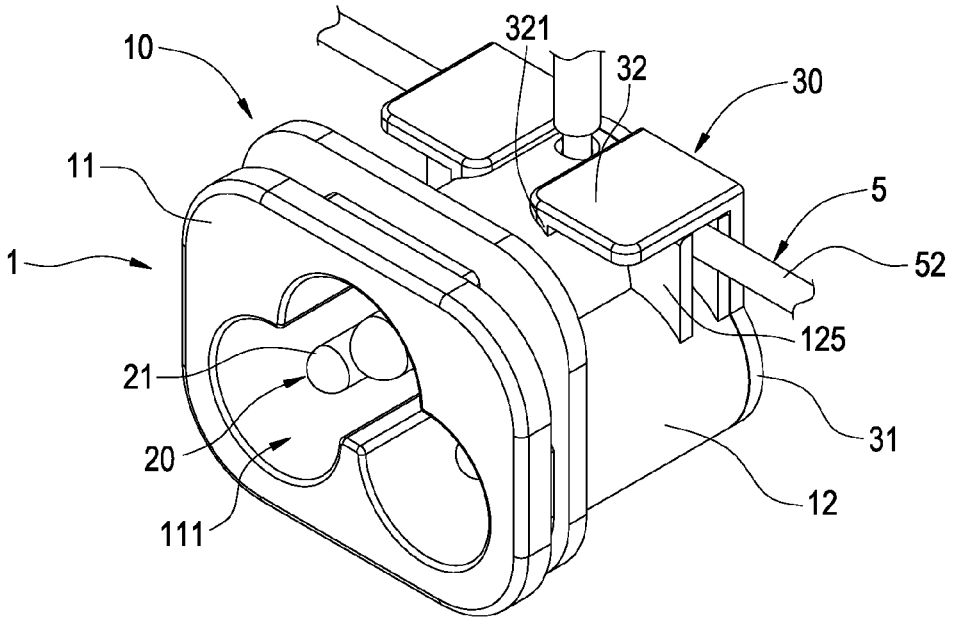
FIG. 4 is a perspective view of a power socket of the present invention after it is combined with each conductive wire.

The insulating base 10 is made of an insulating material and formed by injection molding, and the insulating base 10 includes a base body 11 which is substantially in the shape of a flat plate, an extension 12 which is substantially in the shape of "凸" and protruded backwardly from the base body 11, and a slot 111 is formed on a front end surface of the base body 11 (as shown in FIG. 4) and deeply and backwardly penetrated into the extension 12, and the extension 12 includes the through holes 121 interconnected to the slot 111, and the axis of each through hole 121 is parallel to the axis of the slot 111.

Figure 2:
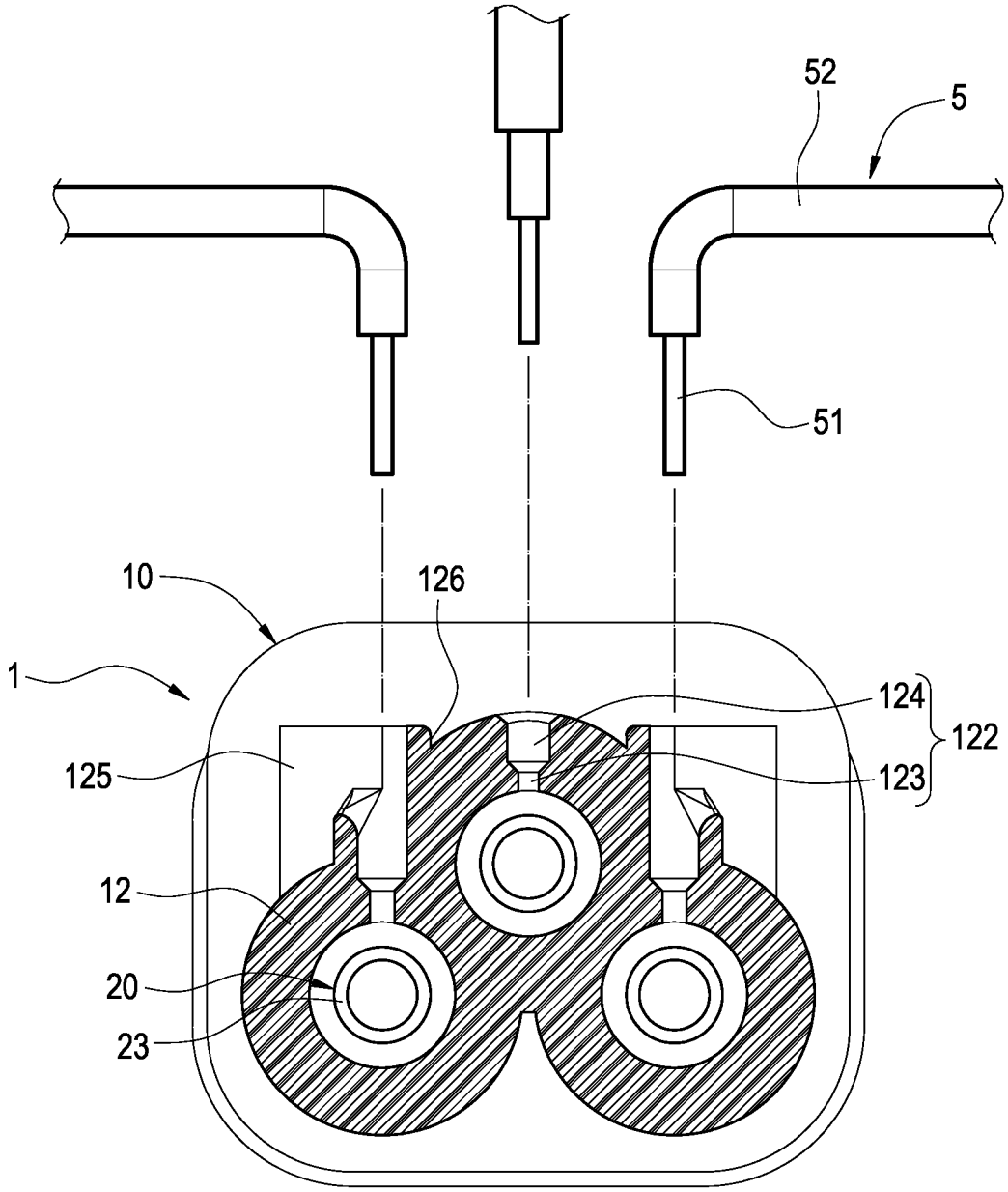
FIG. 2 is a schematic view of a power socket of the present invention before it is combined with each conductive wire.

The extension 12 has a penetrating hole 122 formed at a position above each through hole 121 and penetrating through the through hole 121, and the axis of the penetrating hole 122 and the axis of the through hole 121 are perpendicular to each other, and the penetrating hole 122 is formed by a small-diameter section 123 and a large-diameter section 124 concentric to the small-diameter section 123 (as shown in FIG. 2), and the small-diameter section 123 is disposed adjacent to the through hole 121, and the large-diameter section 124 is formed on an outer side of the small-diameter section 123.

A fender 125 is extended upwardly from the external periphery of the penetrating hole 122 formed separately on both lateral sides of the extension 12, and the fender 125 is substantially U-shaped, and a latch slot 126 is formed between the external periphery of each fender 125 and the extension 12.

The conductive pin 20 is made of metal or any highly conductive material, and the quantity of the conductive pins 20 may be two or three, and three conductive pins 20 are adopted in this preferred embodiment. The conductive pin 20 may be a hollow tube or a solid rod, and each conductive pin 20 has a conducting end 21, a fixing section 22 extended from the conducting end 21 and a soldering end 23 formed at an end of the fixing section 22, wherein the fixing section 22 is embedded into the through hole 121, and the conducting end 21 is exposed from the slot 111, and the soldering end 23 is formed on an inner side of the penetrating hole 122.

Figure 5:
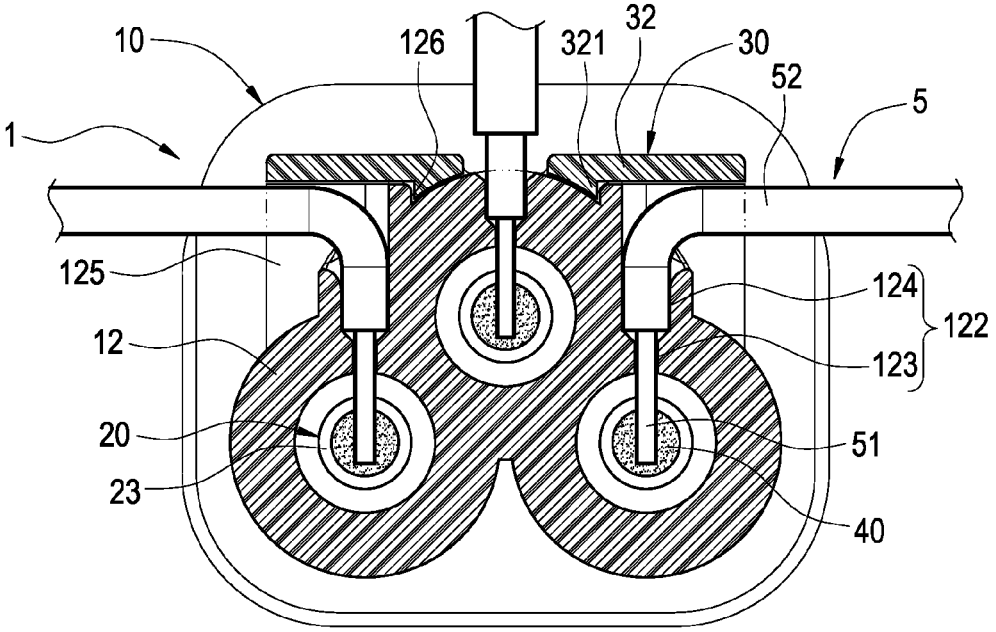
FIG. 5 is a sectional view of FIG. 4.

Preferably, the power socket 1 of the present invention further comprises a cover plate 30 covered onto the extension 12, and the cover plate 30 is made of an insulating material, and the cover plate 30 includes a vertical plate 31, a pair of shutters 32 extended and bent to a right angle from the top of the vertical plate 31, and three hole plugs 311 protruded from an inner wall of the vertical plate 31, and each hole plug 311 is passed and coupled to the respective through hole 121, and the vertical plate 31 covers the rear end surface of the extension 12, and each shutter 32 covers the top of the fender 125, and a latch arm 321 is formed on an inner side of the shutter 32 and at a position corresponding to the latch slot 126, such that the latch arm 321 and the latch slot 126 can be latched and coupled to each other (as shown in FIG. 5).

Figure 6:
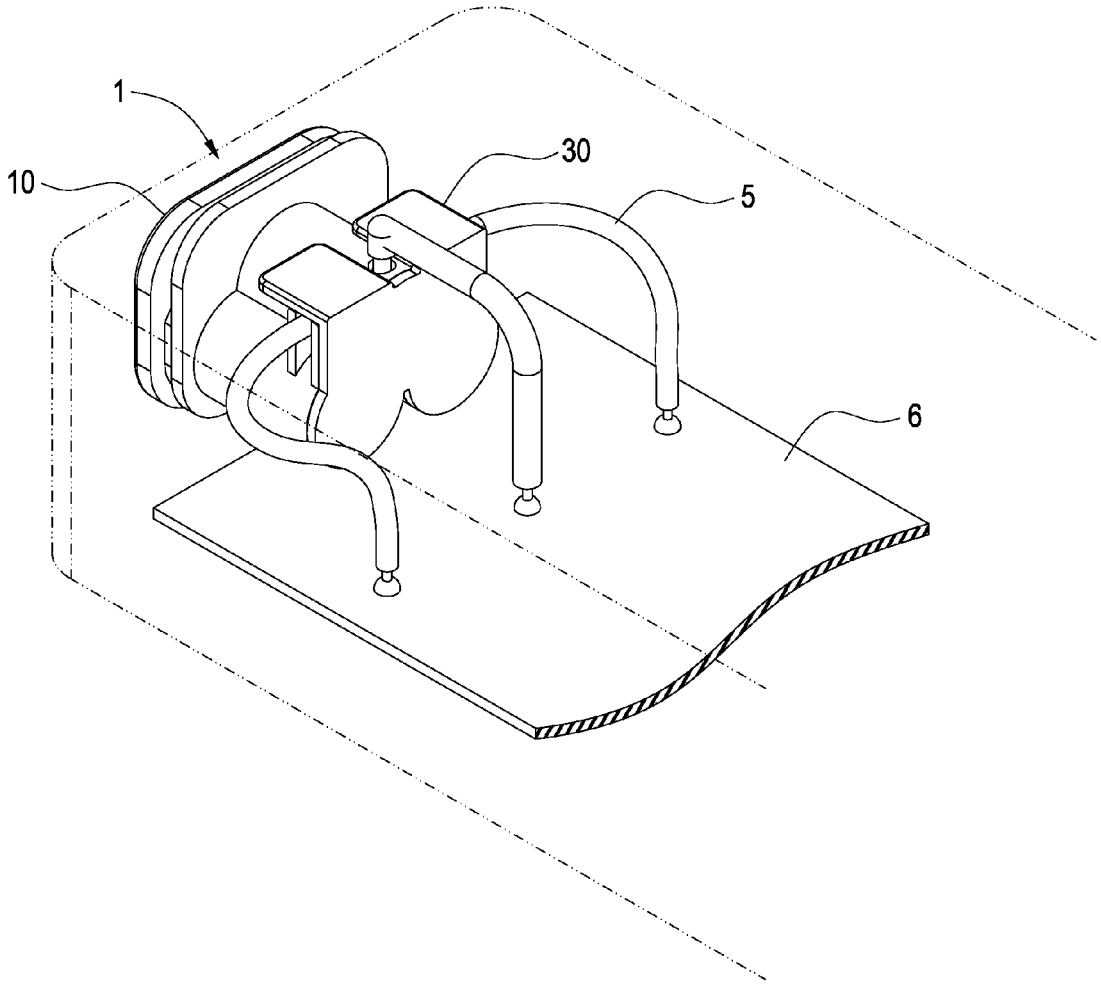
FIG. 6 is a perspective view of an adapter of the present invention.

With reference to FIG. 6, the present invention further provides an adapter comprising a power socket 1, a plurality of conductive wires 5 and a printed circuit board 6, and the power socket 1 includes an insulating base 10 and a plurality of conductive pins 20. The insulating base 10 and the conductive pin 20 have been described above, and thus will not be repeated. The quantity of the conductive wires 5 is equal to the quantity of the conductive pins 20, and each conductive wire 5 has a core wire 51 and a cladding layer 52 covered onto the exterior of the core wire 51 by injection molding. An end of the conductive wire 5 is electrically coupled to the conductive pin 20, and the other end of the conductive wire 5 is electrically coupled to the printed circuit board 6.

Figure 3:
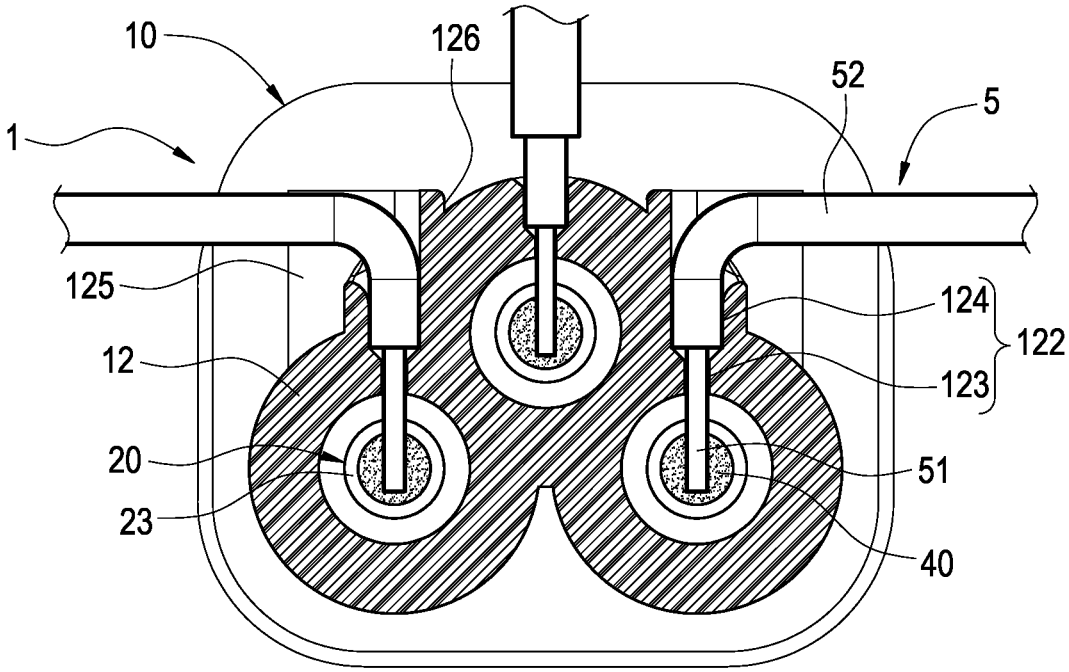
FIG. 3 is a sectional view of a power socket of the present invention after it is combined with each conductive wire.

In FIGS. 2 to 5, an end of the conductive wire 5 is passed to the inside from the penetrating hole 122 when the power socket 1 and each conductive wire 5 are assembled, wherein the core wire 51 is passed and coupled to the small-diameter section 123 and the through hole 121, and the cladding layer 52 is blocked and formed in the large-diameter section 124, and a soldering material 40 is soldered and filled from the through hole 121 to achieve the effect of fixing and electrically coupling an end of the conductive wire 5 to an end of the conductive pin 20 (as shown in FIG. 3). In addition to the aforementioned combining method, spot welding and ultrasonic methods can be used instead. The vertical plate 31 of the cover plate 30 is covered onto a rear end surface of the extension 12, and each hole plug 311 is plugged into the through hole 121, and each shutter 32 is covered onto the top of the fender 125, and the latch arm 321 of the shutter 32 is latched and coupled to the latch slot 126, and each shutter 32 shelters the top of an end of the conductive wire 5 such that the electric arcs and sparks produced while electrically conducting the conductive wire 5 can be shielded completely (as shown in FIG. 5).

In summation of the description above, the present invention achieves the expected objectives and overcomes the drawbacks of the prior art, and the invention complies with patent application requirements, and is thus duly filed for patent application.

While the invention has been described by means of specific embodiments, numerous modifications and variations could be made thereto by those skilled in the art without departing from the scope and spirit of the invention set forth in the claims.

What is claimed is:

1. A power socket connecting with a plurality of conductive wires, the power socket, comprising:

an insulating base, including a base body, an extension protruded outwardly from the base body, a slot formed on an end surface of the base body, a plurality of through holes formed on the extension and interconnected with the slot, and a penetrating hole formed on the extension and at a position corresponding to each respective through hole and penetrating through the through hole, wherein the plurality of conductive wires are inserted into the penetrating hole, and the plurality of conductive wires are formed with a bending section close to an opening of the penetrating hole; the penetrating hole has an axis perpendicular to an axis of the through hole; and a plurality of conductive pins, embedded into the through hole, and an end of each conductive pin being exposed from the slot, and the other end of each conductive pin being formed on an inner side of the through hole, wherein the conductive pin includes a conducting end, a fixing section extended from the conducting end, and a soldering end formed at an end of the fixing section, wherein diameters of the soldering end and the fixing section are larger than that of the conducting end; the fixing section is embedded into the through hole, and the conducting end is exposed from the slot, wherein the soldering end is formed at an intersection of the penetrating hole and the through hole.

2. The power socket of claim 1, wherein the penetrating hole includes a small-diameter section and a large-diameter section concentric with the small-diameter section, and the small-diameter section is disposed adjacent to the through hole, and the large-diameter section is formed on an outer side of the small-diameter section.

3. The power socket of claim 1, further comprising a cover plate covered onto the extension.

4. The power socket of claim 3, wherein the cover plate includes a vertical plate and a pair of shutters bent and extended from the vertical plate, and a fender is extended upwardly from the external periphery of the penetrating hole of the extension, and the vertical plate is covered onto an end surface of the extension, and each shutter masks each respective fender.

5. The power socket of claim 4, wherein the vertical plate includes a plurality of hole plugs extended from an internal wall of the vertical plate, and each hole plug is plugged into each respective through hole.

6. The power socket of claim 4, further comprising a latch slot formed between the external periphery of the fender and the extension, and a latch arm formed on an inner side of the shutter and at a position corresponding to the latch slot, such that the latch slot and the latch arm are latched and coupled to each other.

7. The power socket of claim 4, wherein the fender is substantially U-shaped.

8. An adapter, comprising:

a power socket, comprising:

an insulating base, including a base body, an extension protruded outwardly from the base body, a slot formed on an end surface of the base body, a plurality of through holes formed on the extension and interconnected with the slot, and a penetrating hole formed on the extension and at a position corresponding to each respective through hole and penetrating through the through hole, wherein the penetrating hole has an axis perpendicular to an axis of the through hole;

a plurality of conductive pins, embedded into the through hole, and an end of each conductive pin being exposed from the slot, and the other end of each conductive pin being formed on an inner side of the through hole;

a plurality of conductive wires, with an end plugged into the penetrating hole and electrically coupled to the conductive pin; and a printed circuit board being parallel to the axis of the through hole, each of the plurality of conductive wires forming a bending section close to an opening of the penetrating hole to be electrically coupled to the printed circuit board, wherein the conductive pin includes a conducting end, a fixing section extended from the conducting end, and a soldering end formed at an end of the fixing section, wherein diameters of the soldering end and the fixing section are larger than that of the conducting end; the fixing section is embedded into the through hole, and the conducting end is exposed from the slot, wherein the soldering end is formed at an intersection of the penetrating hole and the through hole.

9. The adapter of claim 8, wherein the penetrating hole includes a small-diameter section and a large-diameter section concentric with the small-diameter section, and the conductive wire includes a core wire and a cladding layer covered onto the exterior of the core wire, and the core wire is passed and coupled to the small-diameter section and the through hole, and the cladding layer is blocked and formed in the large-diameter section.

10. The adapter of claim 9, wherein the soldering end is formed on an inner side of the through hole and combined with the core wire through a soldering material.

11. The adapter of claim 8, further comprising a cover plate covered onto the extension.

12. The adapter of claim 11, wherein the cover plate includes a vertical plate and a pair of shutters bent and extended from the vertical plate, and a fender is extended outwardly from the external periphery of the penetrating hole of the extension, and the vertical plate is covered onto an end surface of the extension, and each shutter covers each respective fender, and an end of the conductive wire is hidden and accommodated in the fender.

13. The adapter of claim 12, wherein the vertical plate has a plurality of hole plugs protruded from an inner wall of the vertical plate, and each hole plug is plugged into each respective through hole.

14. The adapter of claim 12, further comprising a latch slot formed between the external periphery of the fender and the extension, and a latch arm formed on an inner side of the shutter and at a position corresponding to the latch slot, such that the latch slot and the latch arm are latched and coupled to each other.

15. The adapter of claim 12, wherein the fender is substantially U-shaped.

* * * * *